US009204746B2

(12) United States Patent
Trudeau et al.

(10) Patent No.: US 9,204,746 B2
(45) Date of Patent: Dec. 8, 2015

(54) VARIABLE FLOW TRAINING CUP

(71) Applicant: Dart Industries Inc., Orlando, FL (US)

(72) Inventors: Raymond J. Trudeau, St. Cloud, FL (US); Maxime R. Richard, Weston, FL (US); Anthony M. De Leo, Orlando, FL (US)

(73) Assignee: Dart Industries Inc., Orlando, FL (US)

( * ) Notice: Subject to any disclaimer, the term of this patent is extended or adjusted under 35 U.S.C. 154(b) by 0 days.

(21) Appl. No.: 13/671,014

(22) Filed: Nov. 7, 2012

(65) Prior Publication Data

US 2014/0124505 A1 May 8, 2014

(51) Int. Cl.
*A47G 19/22* (2006.01)

(52) U.S. Cl.
CPC ..... *A47G 19/2272* (2013.01)

(58) Field of Classification Search
CPC ..... A47G 19/2266; A47G 19/2272
USPC ..... 220/235, 254.8, 259.3, 714, 719, 220/203.05, 731, 202, 203.06, 203.04
See application file for complete search history.

(56) References Cited

U.S. PATENT DOCUMENTS

| | | | | |
|---|---|---|---|---|
| D346,932 | S | 5/1994 | Cautereels et al. | |
| D354,416 | S | 1/1995 | Cautereels et al. | |
| 5,680,951 | A * | 10/1997 | Feltman et al. | 220/253 |
| 5,890,619 | A * | 4/1999 | Belanger | 220/713 |
| D429,443 | S | 8/2000 | D'Alessio | |
| D479,946 | S | 9/2003 | Jalet et al. | |
| 6,783,020 | B2 * | 8/2004 | Featherston et al. | 220/254.8 |
| 8,272,525 | B1 * | 9/2012 | La Torre et al. | 220/254.1 |
| 2004/0040962 | A1 * | 3/2004 | Bielecki et al. | 220/254.1 |
| 2004/0222230 | A1 * | 11/2004 | Samson et al. | 220/711 |
| 2005/0115977 | A1 * | 6/2005 | Dibdin et al. | 220/714 |
| 2010/0300904 | A1 * | 12/2010 | Sharon | 206/222 |
| 2011/0174830 | A1 * | 7/2011 | Liao | 220/713 |

* cited by examiner

*Primary Examiner* — Anthony Stashick
*Assistant Examiner* — Robert Poon
(74) *Attorney, Agent, or Firm* — Taylor J. Ross

(57) ABSTRACT

A training cup for children includes a cup body. A flow cap having an annular flow gap is selectively mounted to the cup body. A control ring is mounted to the flow cap for relative longitudinal movement toward and away from the cup body. The control ring includes an annular plug. In a first position the plug will block the flow gap to prevent flow from the training cup. In a second position the plug is spaced from the flow gap to allow restricted flow from the training cup. An infinite variation of positions and flow restriction are allowed between this first and second position. The control ring includes a drinking rim which has a minimum diameter of approximately 42 mm to force the child to engage the drinking rim with the lips and use it as a cup.

4 Claims, 2 Drawing Sheets

VARIABLE FLOW TRAINING CUP

CROSS REFERENCE TO RELATED APPLICATIONS

This application is related to co-pending design U.S. Ser. No. 29/436,581, filed herewith.

STATEMENT REGARDING FEDERALLY SPONSORED RESEARCH

Not applicable.

BACKGROUND OF THE INVENTION

The present invention relates in general to training cups for toddlers and small children. In particular, the present invention relates to an improved drinking device having properties of a cup for drinking but which may have a variable restriction on flow to allow training to use a cup as well as to allow for sealing against spilling during travel.

Infants begin feeding using the mother's breast and bottles having similarly shaped nipples. The transition from nipples to a fully open cup is difficult for small children. There are many training cups available commercially, with a common form being a sippy cup, where a standard cup body is provided with a cover having an aperture protrusion. While these sippy cups help train the child on the gross arm and hand movements of lifting and tilting the cup, they do not train the child on the fine mouth and lip movements necessary to drink from a cup rim.

SUMMARY OF THE INVENTION

An object of the present invention is to provide an child's training cup having a variable restriction on flow.

Another object of the present invention is to provide a training cup which may be fully closed for travel.

These and other objects are achieved by a variable flow training cup. The device includes a cup body having an upper rim. Selectively connected to the upper rim is a variable flow cover. The cover includes a flow cap directly connected to the cup body and which includes a central panel surrounded by a flow gap extending through the flow cap. A control ring is mounted to the flow cap. The control ring includes a peripheral drinking rim similar to a standard cup. The control ring further includes an annular plug sized to close the flow gap and receive the central panel therein. The control ring is connected to the flow cap so as to allow the control ring to move longitudinally between a first position and second positions. In the first position the plug closely surrounds the central panel and blocks the flow gap to prevent flow of liquids. In the second position, the control ring is moved longitudinally away from the cup body with the plug spaced from the central panel thus opening the flow gap to permit flow of liquids out from the cup body. The connection between the flow cap and control ring is preferably such that an infinite number of intermediate positions may also be maintained, as by a threaded connection, so as to allow variable flow. The child may this drink from the present cup using a standard tipping motion and drink from a standard cup rim, but with the flow restricted to reduce spilling.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
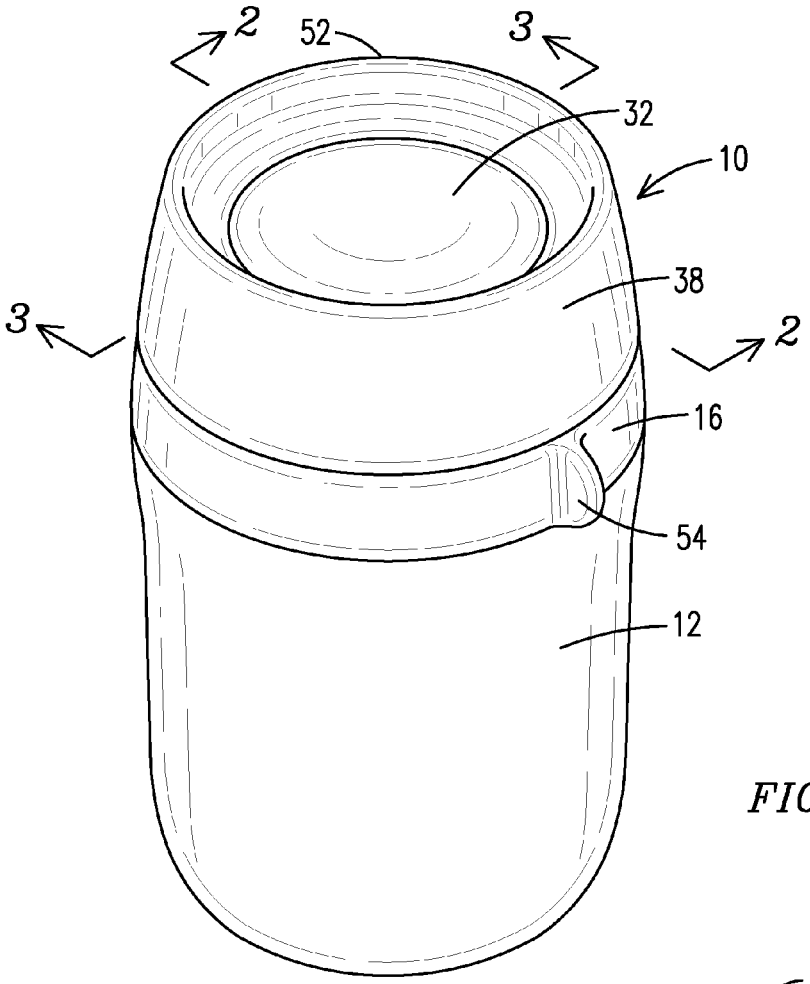
FIG. 1 is a top perspective view of a variable flow training cup according to the present invention.

With reference to FIG. 1, a variable flow training cup according to the present invention is generally designated by reference numeral 10. The training cup 10 generally includes a cup body 12 having a concave configuration with a sidewall ending at an upper rim 14. A flow cap 16 is selectively mounted to the upper rim 14. In particular, the flow cap 16 is generally circular and includes a peripheral mounting skirt 18 extending downward. This mounting skirt 18 selectively connects to the upper rim 14 by a snap fit, or preferably a threaded connection, and may include a gasket 20 for a liquid-tight seal.

The flow cap 16 includes a cylindrical adjustment ring 22 extending upward from the mounting skirt 18, with the adjustment ring 22 including a set of exterior threads 24. While not necessary, it is preferred that the adjustment ring have a smaller diameter than that of the mounting skirt 18. It is also preferred that the mounting skirt 18 and adjustment ring 22 be formed monolithically.

Figure 4:
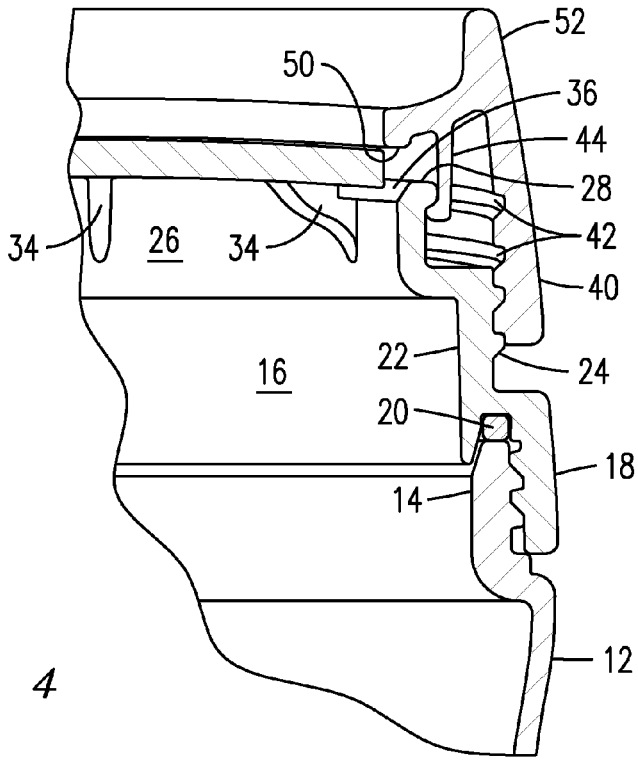
FIG. 4 is a detail cross sectional view similar to FIG. 3 with the ring member in the second, open position.

Extending upward from the adjustment ring 22 is a cylindrical sealing ring 26. The sealing ring 26 has a diameter smaller than that of adjustment ring 22, and terminates a flow rim 26. The flow rim 28 preferably includes a first sealing ridge 30 extending radially outward. A circular central panel 32 is mounted adjacent to, but spaced from, the flow rim 26 by a series of spars 34. As may be seen, this central panel 32 will serve to obstruct, but not block, the opening formed by the flow rim 26. In particular, an annular flow gap 36, best shown in FIG. 4, is formed between the central panel 32 and flow rim 28. In the embodiment shown, the edge of the central panel 32 is offset radially inward and upward of the flow rim 28. Some variation is possible here. The edge of the central panel could be extended outward to extend over a portion of the flow rim 28 if desired, or the outer edge of the central panel could be offset radially inward and slightly below the flow rim 28. All that is strictly necessary is that the resulting flow gap 36 be capable of being sealed as described more fully below.

As may be envisioned, the flow cap 16 will obstruct the outward flow of liquid (not shown) from the interior of the cup body 12, but that liquid could still flow freely from the flow gap 36. To control this flow, the training cup 10 also includes a control ring 38.

Figure 2:
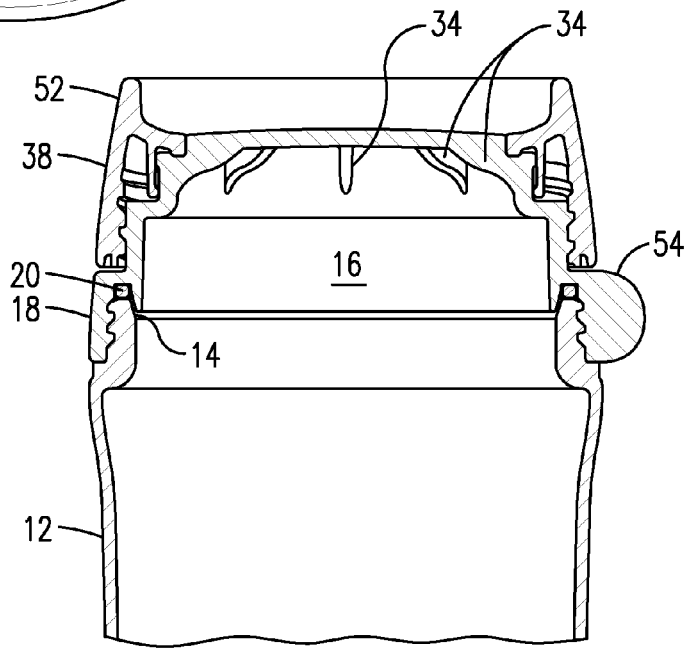
FIG. 2 is a cross-sectional view along line 2-2 of FIG. 1.
Figure 3:
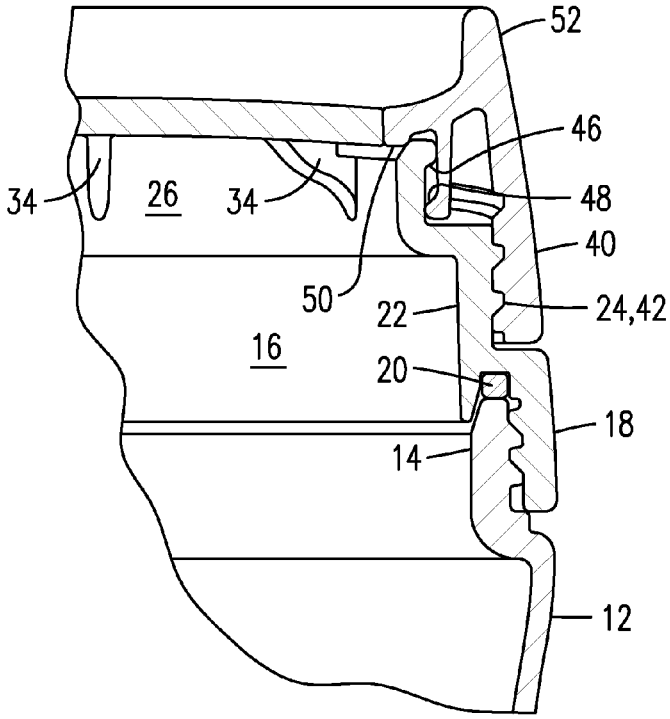
FIG. 3 is a detail cross sectional view along line 3-3 of FIG. 1 with the ring member in the first, closed position.

The control ring 38 is circular in shape, and includes a cylindrical, downward directed, adjustment skirt 40. The adjustment skirt 40 is sized to closely surround the adjustment ring 22, and the interior of the adjustment skirt 40 includes threads 42 which mate with the threads 24. This threaded connection allows the control ring 38 to be rotated relative to the flow cap 16, with this relative rotation causing the control ring to move longitudinally upward or downward (that is, away from, or toward, the cup body 12) relative to the flow cap 16. In particular, this relative rotation allows the control ring 38 to move from a first, closed position illustrated in FIGS. 1-3, and a second, open position illustrated in FIG. 4.

Spaced radially inward from the adjustment skirt 40 is a cylindrical, downward directed, sealing skirt 44. The sealing skirt 44 is sized to closely surround the sealing ring 26 and will have a sliding engagement with the flow rim 28. This sliding engagement is preferred to be tight to reduce the passage of liquid therebetween, and so it is preferred that one or both of the sealing skirt 44 and sealing ring 26 be formed of an elastomeric material. While not required, it is preferred that the flow rim 28 includes a first sealing ridge 46 directed radially outward, and that the sealing skirt 44 include a second sealing ridge 48 directed radially inward and of the same height as the first sealing ridge 46. These sealing ridges 46 and 48 are placed such that they will abut each other when the control ring is in the second, open position. As may be envisioned, thus abutment will block further longitudinal movement of the control ring 38 upward, and can actually serve to define the second, open position.

The control ring 38 also includes an annular plug 50 spaced inwardly of the sealing skirt 44. The plug 50 is positioned and shaped so as to block and seal the flow gap 36 when the control ring is in the first, closed position. In the second, open position the plug 50 will be longitudinally spaced from the flow gap 36 so as to allow the free flow of liquid through the flow gap 36. As may be envisioned, the threaded connection of the control ring 38 to flow cap 16 will allow for an infinite variation of positions between the first, closed position and the second, open position, such that flow of liquid from the training cup 10 may be varied considerably from a very limited flow to a full flow similar to a normal open cup.

The structure described above is similar to existing spout caps, but the present invention differs in two important respects.

A first difference is a cylindrical drinking rim 52 extending upward (away from the cup body 12) from the control ring 38. The drinking rim 52 allows the control ring 38 to be treated as the usual upper free rim of a cup, with the user's lips engaging a limited radial extent of the rim 52.

A second difference is the overall diameter of the control ring 38, and in particular the diameter of the drinking rim 52. As noted, it is important that the drinking rim 52 be treated as a normal rim of a cup, and as such the drinking rim 52 will have minimum diameter of approximately 42 (forty-two) mm. By this it is meant that the smallest diameter of the drinking rim 52 would be 42 mm, give or take a few mm, but that diameter could be considerably larger. Preferably, the diameter would be on a scale similar to that of common drinking cups, the better to train the child. This larger diameter will prevent the child from placing the entire drinking rim 52 within their mouth and using it as a spout. Rather, this large diameter will force the child to use his or her lips to engage a limited periphery of the drinking rim, as with a normal cup. Further, it is preferred that the central panel 32 and thus the flow gap 36 also have a relatively proportional and large diameter. This larger diameter of the flow gap will cause at least a portion of the flow gap to extend above the surface of the liquid during dispensing to act as a vent to the interior of the cup body and prevent any negative pressure.

In use, the user may grip the mounting skirt 18 of the flow cap 16 to remove or attach the flow cap (with control ring 38 connected thereto) from or to the cup body 12. This allows liquid to be placed into the training cup 10 prior to drinking. The control ring 38 may be placed in the first, closed position during travel or other situations in which it is desired to prevent dispensing from the training cup 10. When the child desires to drink from the training cup 10, the control ring 38 is rotated relative to the flow cap 16 so as to open the flow gap 36 and allow liquid to flow therefrom. The amount which the flow gap is opened will vary depending upon the amount of rotation of the control ring 38, up to the second, open position. The amount of flow from the training cup 10 may thus be adjusted, and in particular limited, so as to restrict flow and thus help the child to train using a real cup without undue spilling. Further, the large diameter of the drinking rim forces the child to use the lips to engage a small radial extent of the drinking rim. In other words, the large diameter of the drinking rim 52 prevents the child from using the drinking rim 52 as a spout (similar to a nipple) and forces a true cup-drinking action for training the child.

As may be envisioned, there may be a number of variations to the basic arrangement which do not depart from the basic concept. For example, the flow cap 16 may include one or more radial tabs 54 to allow better manual leverage for the user to connect or disconnect the flow cap 16 to the cup body 12. Similar tabs (not shown) could be provided on the control ring 38 to ease its relative rotation between the first and second positions. Other useful variations will be apparent to those skilled in the art.

From the foregoing it will be seen that this invention is one well adapted to attain all ends and objects set forth above together with the other advantages which are inherent within its structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth of shown in the accompanying drawings is to be interpreted as illustrative, and not in a limiting sense.

What is claimed is:

1. A variable flow cup, comprising:

a cup body having a concave form ending in an upper rim;

a flow cap selectively secured to said upper rim, said flow cap having a circular central panel surrounded by a flow gap through which liquid may flow out of said cup, and further including a set of exterior threads on an outer periphery of said flow cap;

a control ring mounted to said flow cap for selective longitudinal movement between first and second positions, said control ring including an adjustment skirt having threads on an interior thereof which mate with said exterior threads whereby rotation of said control ring relative to said flow cap causes said movement between said first and second positions, said control ring further including an annular plug which seals said flow gap when said control ring is in said first position and which is spaced from said flow gap when said control ring is in said second position, said control ring further including a peripheral drinking rim extending longitudinally outward therefrom, said peripheral drinking rim having a diameter of no less than about 42 mm.

2. A cup as in claim 1, wherein said control ring is mounted to said flow cap by a threaded connection.

3. A cup as in claim 1, wherein said flow cap further includes a sealing ring outside of and longitudinally downward from said flow gap, and wherein said control ring further includes a sealing skirt closely surrounding said sealing ring.

4. A cup as in claim 3, wherein said control ring is mounted to said flow cap by a threaded connection.

* * * * *